US005823458A

United States Patent [19]

Huang

[11] Patent Number: 5,823,458

[45] Date of Patent: Oct. 20, 1998

[54] CABLE SPOOL WITH A DAMPING BRAKE

[75] Inventor: Wen-Cheng Huang, Hsin-Chu, Taiwan

[73] Assignee: Jin Fong Hydrauli Company

[21] Appl. No.: 844,329

[22] Filed: Apr. 18, 1997

[51] Int. Cl.[6] ..... B65H 75/30

[52] U.S. Cl. ..... 242/396.6; 242/422.9; 242/599.4

[58] Field of Search ..... 242/422.9, 599.2, 242/599.3, 599.4, 129.8, 156.2, 396.6, 396.9; 254/375

[56] References Cited

U.S. PATENT DOCUMENTS

| | | | |
|---|---|---|---|
| 993,550 | 5/1911 | Robeson | 242/422.9 |
| 3,151,819 | 10/1964 | Hodgdon | 242/156.2 |
| 3,355,122 | 11/1967 | Thatcher | 242/422.9 |
| 3,411,734 | 11/1968 | Greenberg et al. | 242/599.3 |
| 3,703,263 | 11/1972 | Hunter | 242/129.8 |
| 3,913,854 | 10/1975 | McClure | 242/422.9 |
| 4,008,861 | 6/1984 | Hortel | 242/599.3 |
| 4,456,198 | 6/1984 | Kosch | 242/129.8 |

*Primary Examiner*—John M. Jillions
*Attorney, Agent, or Firm*—Rosenberg, Klein & Bilker

[57] ABSTRACT

The present invention relates to a cable spool with a damping brake, which has a modified central supporting axle with a combination of circular and square parts. The circular sectional part of the supporting axle is used for supporting the spool and the brake disk, the square sectional part at the axle end is used for fixing the brake clamps and for supporting to a fixture. The square sectional part at the middle of the axle will be mounted with a brake holder having square axle hole and a brake shoe. The brake force can be adjusted by a spring. During operation, the cable spool is pulled by an external force to release the cable, and a spool rib will immediately drive the brake disk, while the brake disk will be braked by the brake holder and the brake shoe. Once the external force stops pulling, the cable spool will stop rotating due to the brake force from the brake shoe. Therefore, the cable remaining on the spool will not release continually. No external power is needed to stop the spool. The working time and manpower are also reduced. Any danger that can occur by means of a manual braking is therefore prevented.

2 Claims, 4 Drawing Sheets

CABLE SPOOL WITH A DAMPING BRAKE

FIELD OF THE INVNETION

The present invention relates to a cable spool with a damping brake, which has a modified central supporting axle with a combination of circular and square parts. The present invention does not need any manual force for stopping the cable spool when an external force stops pulling of the cable spool, thereby eliminating any danger which may happen by means of a manual operation.

BACKGROUND OF THE INVENTION

As the pace of industry is progressing, the industry safety is becoming more important. The power source used by industry is generally transmitted by an electric wire/cable which is wound around a cable spool axle. The cable spool axle is circular in section, and can be rotated by an external force very easily. However, when the external force stops pulling the cable, the rotational inertia of the cable spool still releases the cable, thus causes tangling of the cable. In order to avoid continuing releasing of the cable when an external force stops pulling, it needs some manual forces to brake the cable spool. But some cable spools may weigh about 6.5 to 7 tons which will incur danger of the operator during manual operation, and since each cable spool needs at least one operator for braking, manpower will be increased.

SUMMARY OF THE INVENTION

The major object of the present invention is therefore to provide a cable spool with a damping brake, so the cable spool will stop rotating automatically as soon as the external force stops pulling the cable.

The next object of the present invention is to provide a cable spool with a damping brake, which can adjust the brake force to overcome the rotational inertia force of the cable spool.

The third object of the present invention is to provide a cable spool with a damping brake, which has achieved the purpose of reducing working time and manpower during operation without using any external power.

BRIEF DESCRIPTIONS OF THE DRAWINGS

The present invention can be better understood by the detailed descriptions of the following drawings, in which.

DETAILED DESCRIPTION OF THE PREFERRED EMBODIMENT

Figure 1:
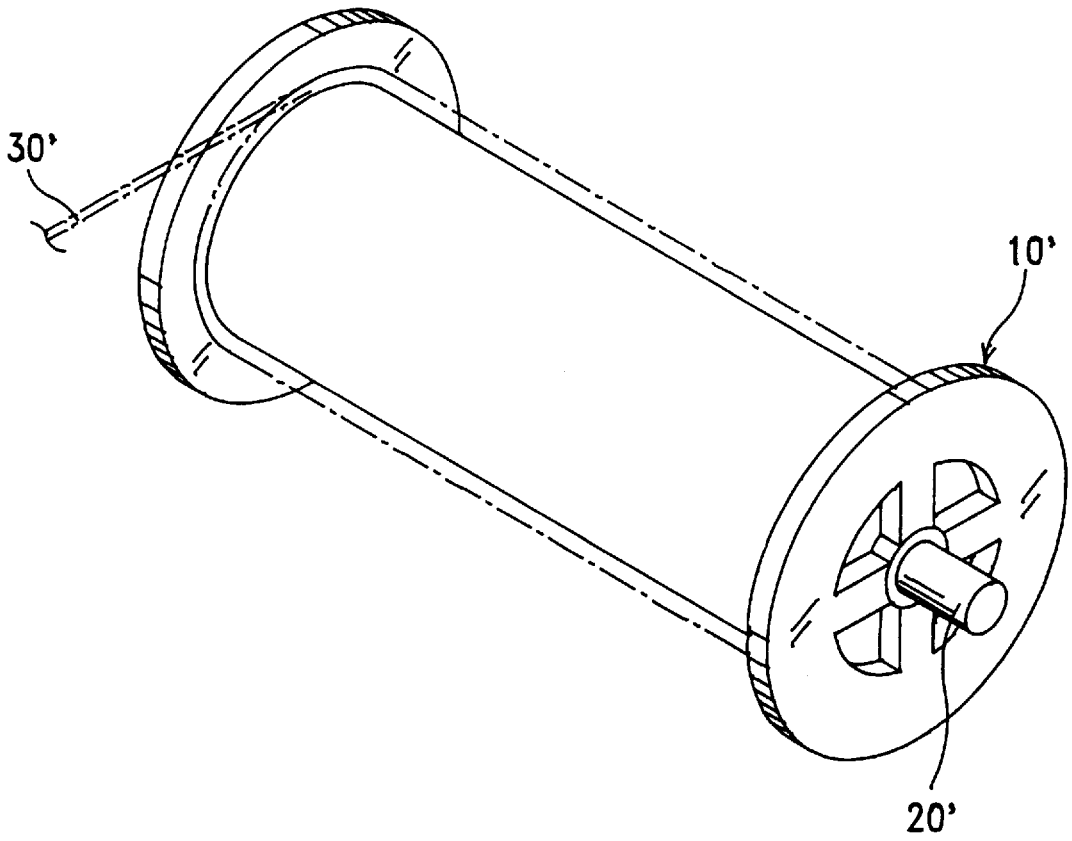
FIG. 1 is a schematic perspective view of a conventional cable spool.

Please refer to FIG. 1, which is a schematic perspective view of a conventional cable spool. The supporting axle 20' of the conventional cable spool 10' is a cylindrical reel, and wound with a cable 30'. During operation, the cable 30' is pulled manually or by a mechanical external force. Once the external force stops pulling, the rotational inertia of the cable spool 10' causes releasing of the cable 30' continually, and the cable will thus tangle together. In order to prevent the cable 30' from releasing, some manpower is needed to brake the cable spool, which would be very dangerous.

Figure 2:
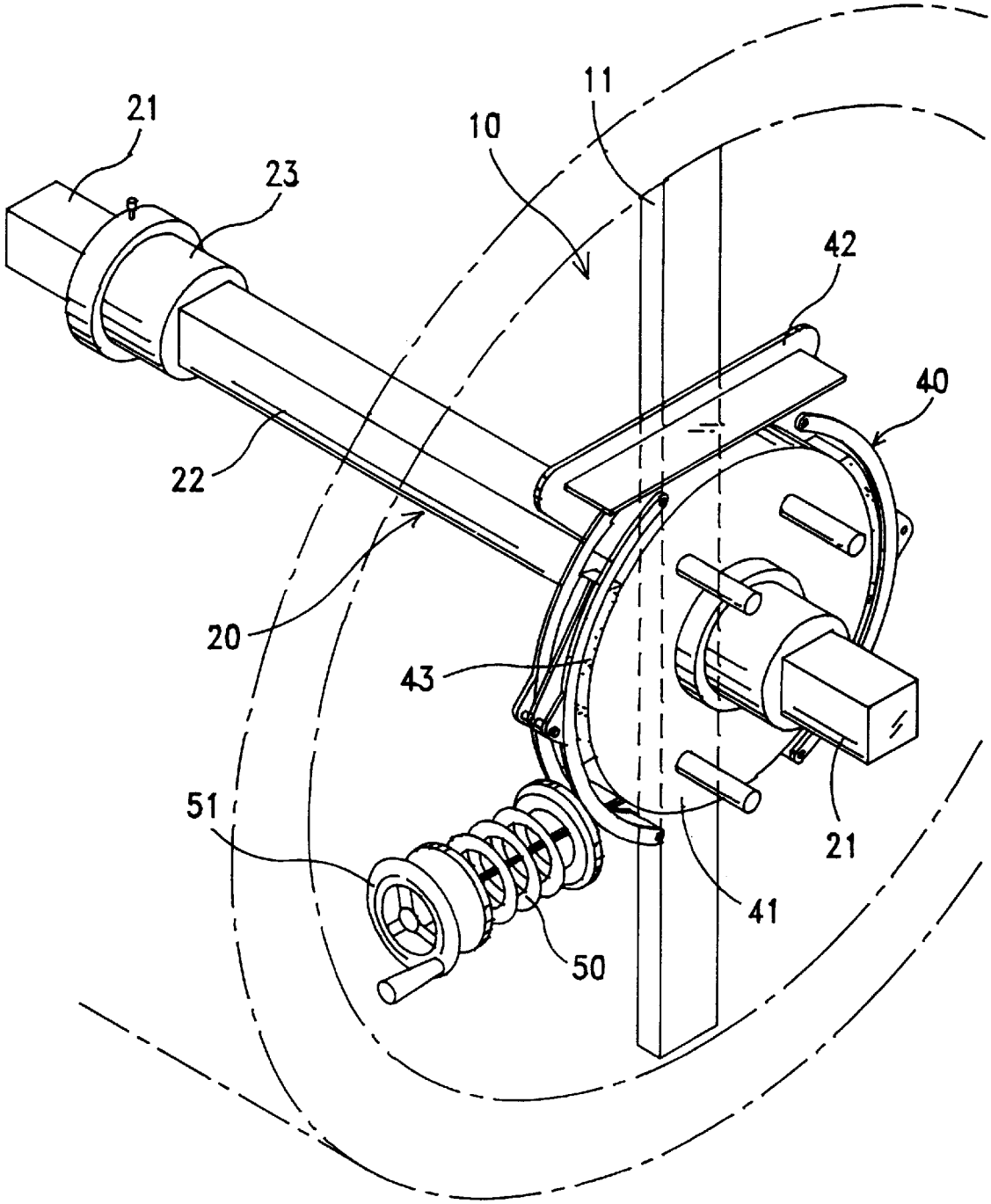
FIG. 2 is a schematic perspective view of the cable spool with a damping brake of the present invention.

Please refer to FIG. 2, which is a schematic perspective view of the cable spool with a damping brake of the present invention. As shown in FIG. 2, the supporting axle 20 of the cable spool 10 of the present invention is modified to be a combination of circular and square parts. The axle ends 21 and the middle part 22 of the axle 20, are formed of a square sectional configurations. One of the square sectional ends 21 of the supporting axle 20 is used for fixing a pair of brake clamps 40, and both ends 21 are used for mounting into square holes of a supporting fixture (not shown). The supporting axle 20 will therefore not rotate. The middle part 22 of the axle 20 is mounted with a brake holder 42 having square axle hole and a brake shoe 43. The brake force can be adjusted to just overcome the rotational inertia force of the cable spool by a hand wheel 51 for controlling the compression force of a spring 50. A circular sectional supporting part 23 of the supporting axle 20 is used for supporting the cable spool 10 and a brake disk 41. The brake disk 41 is driven to rotate by a spool rib 11.

Figure 3:
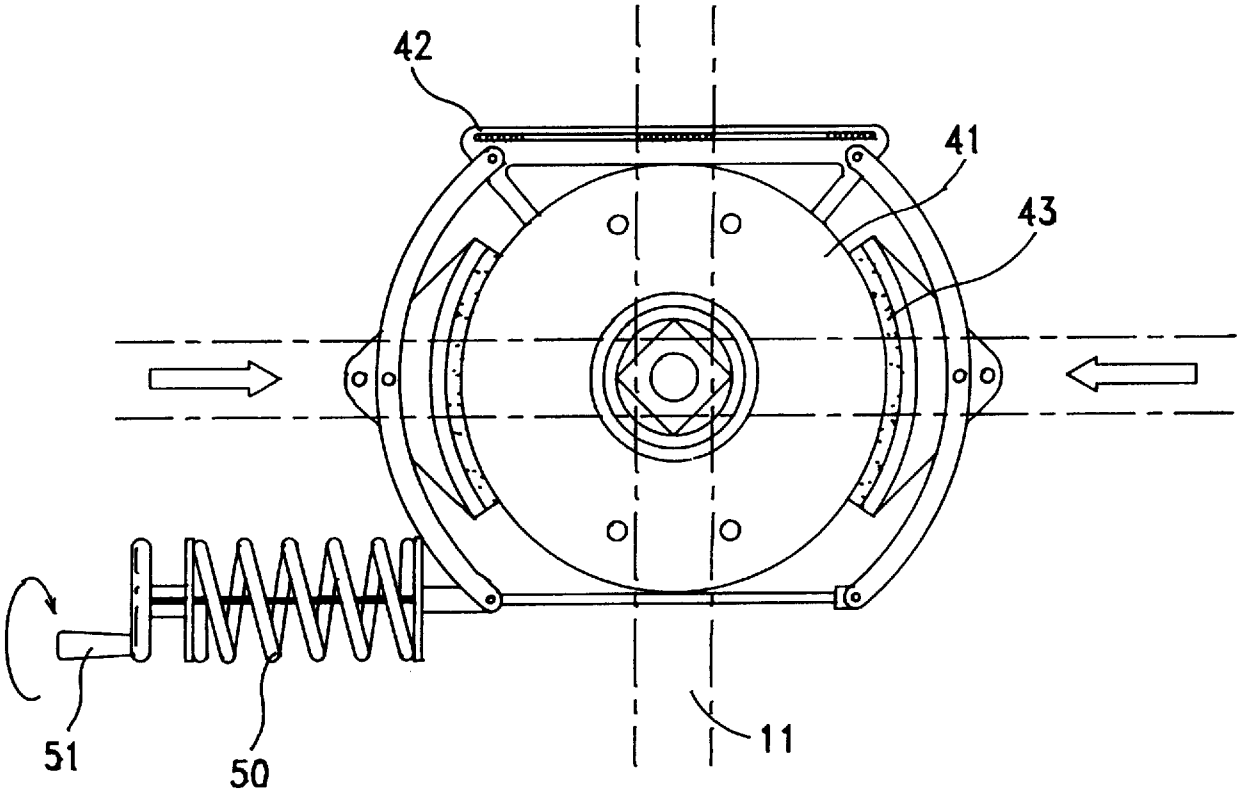
FIG. 3 is a schematic operation diagram of the cable spool with a damping brake of the present invention.
Figure 4:
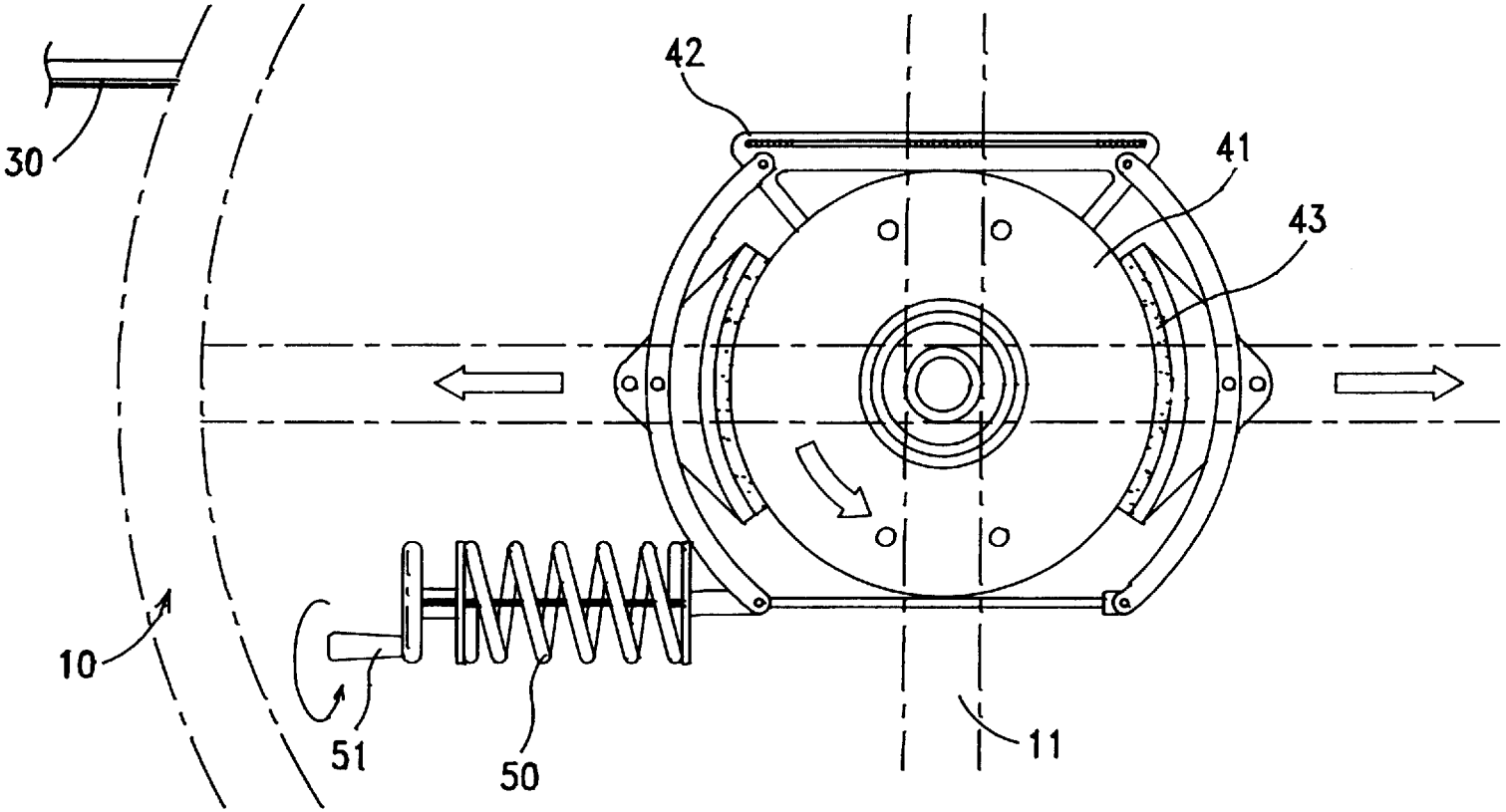
FIG. 4 is another schematic operation diagram of the cable spool with a damping brake of the present invention.

Please refer to FIG. 3 and FIG. 4, which are schematic operation diagrams of the cable spool damping brake of the present invention. When the cable spool 10 is pulled by an external force to release the cable, the spool rib 11 will immediately drive the brake disk 41 and a pair of brake clamps 40, while the brake disk 41 will be damping braked by the brake holder 42 and the brake shoe 43. Once the external force stops pulling, the cable spool 10 will stop rotating due to the brake force from the brake shoe. Therefore, the cable 30 remaining on the spool 10 will not release continually. No external power is needed according to the present invention. The working time and manpower are also reduced. The brake force can be adjusted by the handwheel 51 to control the compression force of the spring 50. The locomotion of the brake shoe 43 and the distance of the brake disk 41 can be driven by controlling the brake clamps 40 so as to be adapted to different specifications of the cable spool 10.

Summing up the above, the present invention has the following advantages:

1. The present invention employs a modified central supporting axle with a combination of circular and square parts. The circular sectional part of the supporting axle is used for supporting the spool and the brake disk, the square sectional part at one axle end is used for fixing the brake clamps loaded with a spring and for supporting. The square sectional part at the middle of the axle is used for mounting the brake holder having a square axle hole and the brake shoe. No external power is needed to stop the rotation of the cable spool, and the working time and manpower are also reduced.

2. Once the external force stops pulling, the cable spool will stop rotating immediately so as to eliminate any danger which will happen by means of a manual braking.

3. The cable spool with a damping brake of the present invention can adjust the brake force by means of a spring so as to be adapted to different specifications of the cable spool.

The above embodiment can be modified by any skillful person in the art without departing from the spirit and scope of the accompanying claims.

What is claimed is:

1. A cable spool with a damping brake comprising:

a supporting axle composed of two square sectional ends fixed in a supporting fixture, a square sectional middle part, and two circular sectional parts disposed on said square sectional middle part;

a cable spool mounted on said circular sectional parts of said supporting axle; and a damping brake assembly including a brake disk mounted on one of said circular sectional parts of said supporting axle and driven to rotate by said cable spool, a brake holder and two brakes shoes fixedly supported on said square sectional middle part of said supporting axle, a pair of brake clamps supported fixedly on one of said square sectional ends of said supporting axle.

2. A cable spool with a damping brake according to claim 1, wherein said brake clamps are loaded with a spring for adjusting a brake force to just overcome the rotational inertia of said cable spool.

* * * * *